US005248224A

United States Patent [19]

Amr

[11] Patent Number: 5,248,224

[45] Date of Patent: Sep. 28, 1993

[54] ORIFICED SHROUD FOR AXIAL FLOW FAN

[75] Inventor: Yehia M. Amr, Manlius, N.Y.

[73] Assignee: Carrier Corporation, Syracuse, N.Y.

[21] Appl. No.: 627,674

[22] Filed: Dec. 14, 1990

[51] Int. Cl.[5] ..... F04D 19/00

[52] U.S. Cl. ..... 415/223; 415/220; 416/189

[58] Field of Search ..... 415/220, 223, 182.1, 415/183, 914; 416/179, 189 R

[56] References Cited

U.S. PATENT DOCUMENTS

| | | | |
|---|---|---|---|
| 1,497,408 | 6/1920 | Seelig | 415/220 |
| 2,123,657 | 7/1937 | Munk | 416/189 R |
| 2,925,952 | 6/1954 | Garve | 415/183 |
| 3,620,640 | 11/1971 | Soulex-Lariviere | 415/126 |
| 4,061,188 | 12/1977 | Beck | 415/207 |
| 4,927,328 | 5/1990 | Scoates et al. | 415/220 |

*Primary Examiner*—Edward K. Look
*Assistant Examiner*—Michael S. Lee

[57] ABSTRACT

A shroud for an axial flow fan having an orifice designed to improve the overall flow efficiency of the fan. In preferred embodiments, the shroud is generally toroidal in form with a cross section that is ellipsoidal in the area of the shroud leading edge with interior and exterior wall segments that taper and converge at the trailing edge of the shroud. The shroud is particularly suited for use with a recessed fan used in the outside enclosure of a "split" air conditioning (including heat pump) system, enabling the same flow of air through the enclosure with less radiated noise than prior art shroud designs.

26 Claims, 3 Drawing Sheets

ORIFICED SHROUD FOR AXIAL FLOW FAN

BACKGROUND OF THE INVENTION

This invention relates generally to the design and construction of shrouds for bladed axial flow fans. More particularly, the invention relates to a shroud for the fan that circulates air through the enclosure that houses the compressor and outside heat exchanger in what are known in the industry as "split" air conditioning (including heat pump) systems.

Efficiency and reduction of radiated noise levels are objectives in the design and construction of all the components of an air conditioning system. Air flow noise is a major contributor to the total radiated noise produced by a number of components of the typical air conditioning system. One such component is the fan that moves air through the outside enclosure and over the refrigerant-to-air heat exchanger contained in the enclosure.

The proper operation of the air conditioning system requires a certain minimum rate of flow of air across the outside refrigerant-to-air heat exchanger. The total air flow rate through the outside enclosure, and hence over the heat exchanger, is a function of the effective area swept by the fan and the average velocity of the air through the fan. In general, fan radiated noise level increases as the air flow velocity through the fan increases. It is therefore an objective in the design of the outside enclosure to achieve the required air flow through the enclosure while keeping air flow velocity and thus fan radiated noise level at a minimum. To achieve this objective, a designer would first look to increasing fan size. Other design considerations such as minimizing the overall dimensions and cost of the enclosure work against such a simple solution and require that other, more sophisticated measures be taken to improve fan efficiency and thus reduce noise.

Other considerations complicate the designer's problem. To minimize the overall height of the unit, the outside enclosure fan and motor are frequently recessed into the top of the annular space between the coiled refrigerant tubing of the heat exchanger. The designer must configure the fan and its associated shrouding so that there is at least some air flow over the uppermost tubing coils of the heat exchanger so that the effective heat transfer area of the heat exchanger is maintained. Safety, aesthetic and other considerations require that a covering grille be fitted on the top of the unit over the discharge of the fan. Air flow noise from the grille is a contributor to overall radiated noise from the enclosure. This noise, like the noise from the fan itself, can be reduced by reducing the maximum air velocity at the grille.

SUMMARY OF THE INVENTION

An object of the present invention is to reduce the overall radiated noise level produced by the components contained in the outside enclosure of a "split" air conditioning (including heat pump) system.

Another object of the present invention is to reduce the radiated air flow noise produced by the fan in a split air conditioning system outside enclosure.

Another object of the present invention is to achieve the required airflows through all parts of an outside enclosure while at the same time minimizing air flow velocity through the fan of the enclosure.

Still another object of the present invention is to produce a fan shroud that will enhance the air flow efficiency of its associated fan by reducing inlet and outlet air turbulence, fan tip leakage and fan sudden expansion losses.

A still further object of the present invention is to produce a fan shroud that is easily manufactured at minimum cost and is aesthetically attractive.

And a further object of the present invention is to combine all of the above objects in a fan shroud that is suitable for use with a recessed enclosure fan.

The invention achieves these and other objects in a fan shroud that promotes nonseparated air flows from all parts of the enclosure, including the portion of the heat exchanger coil that is uppermost in the enclosure, into the fan and out of the enclosure through the fan discharge.

In preferred embodiments of the invention, the fan shroud is a generally toroidal member that when installed surrounds the fan. The shroud has a cross section, when sectioned by a plane through the axis of generation of the toroidal member, that is generally ellipsoidal in the area of the inlet throat of the shroud and then converges and tapers toward the discharge end of the shroud.

The shroud can be manufactured out of any suitable material but is particularly adapted to fabrication out of a plastic material by, for example, the blow molding process.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1A:
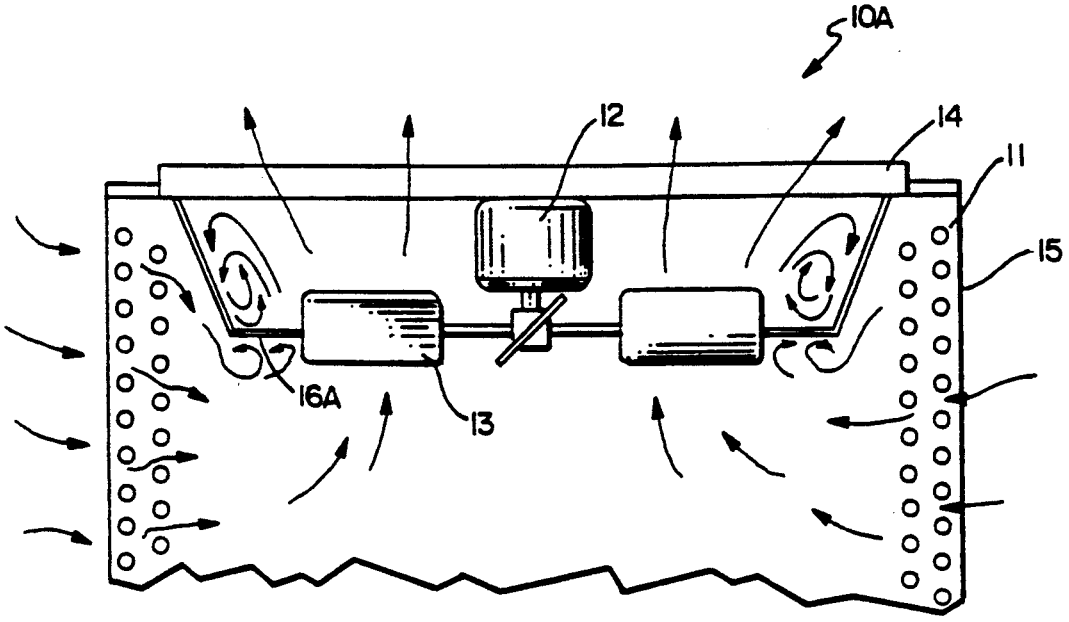
FIG.1A PRIOR ART
FIG. 1A is a sectioned elevation view of the upper portion of the outside enclosure of a split air conditioning system employing a prior art fan shroud having a recessed sharp edged fan orifice.
Figure 1B:
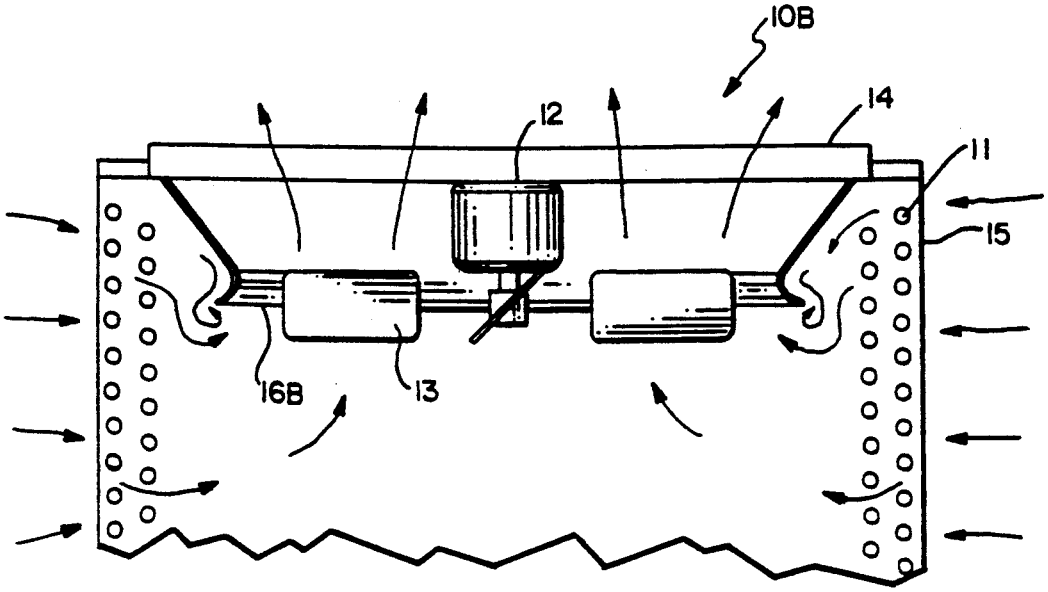
FIG.1B PRIOR ART
FIG. 1B is a sectioned elevation view of the upper portion of the outside enclosure of a split air conditioning system employing a prior art fan shroud having a reflared fan orifice.

FIGS. 1A and 1B, in sectioned elevation views, depict the upper portion of the outside enclosure of a split air conditioning system with two different types of prior art orificed shrouds, each fitted around a recessed fan. Both FIGS. 1A and 1B depict an outside enclosure 10A or 10B having air permeable housing 15 enclosing refrigerant-to-air heat exchanger 11, comprising a tube or tubes coiled and surrounding a central cavity that may contain the system compressor (not shown) and other system components. Fan motor 12, mounted to motor mount and grille assembly 14, drives fan 13.

FIG. 1A shows shroud and orifice assembly 16A, which is of the recessed sharp edged type. FIG. 1B shows shroud and orifice assembly 16B, which is of the recessed reflared type.

As shown by the flow arrows in FIGS. 1A and 1B, fan 13 draws air from outside enclosure 10A or 10B through air permeable housing 15, across refrigerant-to-air heat exchanger 11 through fan 13 and out of the unit through motor mount and grille assembly 14. Shroud and orifice assemblies 16A or 16B direct the flow of air into the inlet of fan 13 and allow for at least some air-flow over that portion of heat exchanger 11 that is higher than the leading edge of fan 13.

The flow arrows in FIG. 1A depict also the separated flow regions at and downstream of the inlet of shroud and sharp edged orifice assembly 16A. The effect of this air flow separation is to restrict the free flow of air out of fan 13, reducing the effective discharge area and efficiency of the fan. Thus, where there is this region of separated flow, to achieve the desired air flow rate through the fan requires that the axial air flow velocity must be greater, with a consequently increased fan speed or blade pitch, either of which will result in a higher noise level. Because of its construction, orientation and position within its enclosure, shroud and orifice assembly 16A easily collects debris and water, further disrupting the air flow through its enclosure as well as having other undesirable consequences.

The flow arrows in FIG. 1B provide another illustration of how the design of prior art shroud and orifice assemblies can contribute to higher noise levels through reduction of the efficiencies of the fans with which they are used. The opening of shroud and reflared orifice 16C makes it necessary that air flowing from the uppermost portion of refrigerant-to-air heat exchanger 11 into fan 13 turn almost 180° upon entering the orifice. This abrupt change in direction results in flow separation in the vicinity of the fan blade tips. This separation in turn causes high blade tip loading, tip leakage, tip vortices and a reduction in effective blade diameter, all of which result in reduced fan efficiency.

Figure 2:
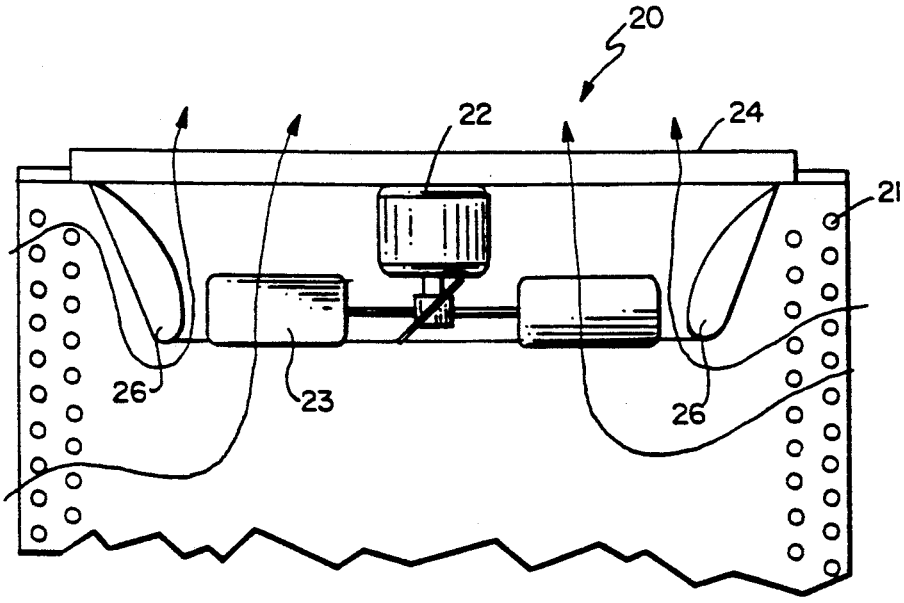
FIG. 2 is a sectioned elevation view of the upper portion of the outside enclosure of a split air conditioning or heat pump system employing a fan shroud incorporating one embodiment of the present invention.

FIG. 2, in a sectioned elevation view, depicts the upper portion of the outside enclosure 20 of a split air conditioning system fitted with orificed shroud 26. The shroud is constructed according to one embodiment of the present invention and fitted around recessed fan 13. Outside enclosure 20 has air permeable housing 25 enclosing refrigerant-to-air heat exchanger 21, comprising a tube or tubes coiled and surrounding a central cavity that may contain the system compressor (not shown) or other system components. Fan motor 22, mounted to motor mount and grille assembly 24, drives fan 23.

Figure 3:
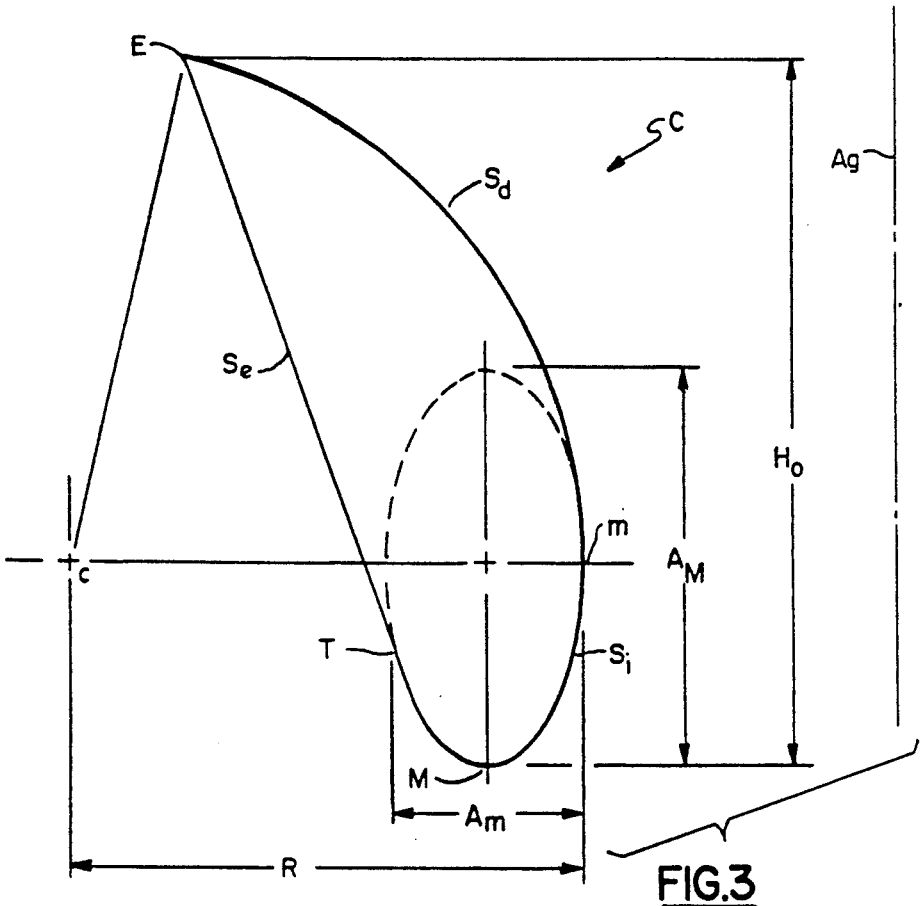
FIG. 3 is a view of the plane closed curve that will, when rotated abut an axis of generation, produce a toroid embodying the principles of the invention.

FIG. 3 depicts the plane closed curve that will, when rotated about an axis of generation, produce a toroid embodying the principles of a preferred embodiment of the present invention. FIG. 3 shows certain additional dimensions and features that will facilitate the below detailed description of orificed shroud 26.

Figure 4:
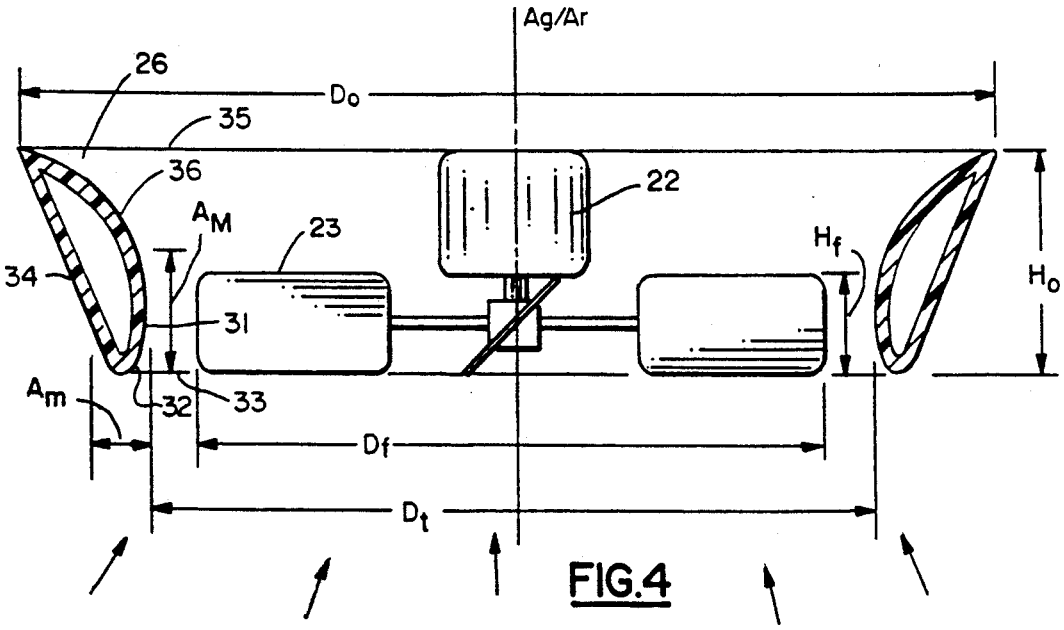
FIG. 4 is a sectioned elevation view of the fan shroud of the present invention depicted installed around a bladed axial flow fan.

FIG. 4 is a sectioned elevation view of a preferred embodiment of the present invention. FIG. 4 depicts orificed shroud 26, fan motor 22 and fan 23 and illustrates certain dimensions and features that will further facilitate the below detailed description of orificed shroud 26. The flow arrows in FIG. 4 show the direction of air flow through orificed shroud 26 and define the upstream or inlet end and the downstream or discharge end of shroud 26. Because of its usual placement in the outside enclosure of a split air conditioning system, the inlet end of shroud 26 can also be referred to as its lower end and likewise, the discharge end can be referred as its upper end. The depicted orientation of shroud 26 has no other particular significance.

An orificed shroud constructed according to the principles of the present invention can be described as a wall structure that is in form like the surface that would be generated by rotating a curvilinear planar line about a coplanar axis of generation coincident with the axis of rotation of the fan with which the shroud is intended to operate. In preferred embodiments of the invention, the curvilinear planar line is a plane closed curve and the surface that would be generated by rotation of the closed curve would therefore be a toroid. Several of the dimensions of the fan and the enclosure with which the toroidal shroud will be used dictate its shape and dimensions. In a plane perpendicular to its axis of generation, the shroud is generally circular or ring-like.

Referring to FIG. 3, The plane closed curve C that will generate the toroidal member is generally ellipsoidal in the part of the curve, curve segment $S_i$, that will generate the leading edge and inlet portion of the toroidal member. The ellipsoid has a major axis $A_M$ and a minor axis $A_m$. Major axis $A_M$ is parallel to axis of generation $A_g$. Point $_m$ is the intersection of the ellipsoid with its minor axis on the side of the ellipsoid that toward the axis of rotation and also the point on the curve that, when rotated, will define the throat, or portion of minimum diameter, of the toroidal member. Point E is the point on the curve that, when rotated, will define the discharge end of the toroidal member. The axial distance from the leading edge to the discharge end is $H_O$.

Referring to FIG. 4, the toroidal member has a throat diameter $D_t$ and a diameter at the discharge end $D_o$. The fan with which orificed shroud 26 is designed to operate has axis of rotation $A_r$ and maximum blade or swept diameter $D_f$. Axis of rotation $A_r$ is coincident with axis of generation $A_g$ of plane closed curve C (FIG. 3). The axial depth from the leading edge to the trailing edge of the fan blade, measured at a point on the blade that is four tenths (0.4) of swept diameter $D_f$ from fan axis of rotation $A_r$, is $H_f$.

In an orificed shroud embodying the preferred embodiments of the invention, the minor axis of the ellipsoid should be in the range of eight to fifteen hundredths (0.08 to 0.15) times the fan swept diameter or $$A_m=(0.08 \text{ to } 0.15)D_f,$$

the aspect ratio (ratio of major to minor axes) of the ellipsoid should be in the range of one and one half to three and one half (1.5 to 3.5) or $$A_M=(1.5 \text{ to } 3.5)A_m, \text{ and}$$

the axial depth of the shroud should be the semimajor axis of the ellipsoid plus one half to two and one half (0.5 to 2.5) times the fan axial depth or $$H_O=A_M/2+(0.5 \text{ to } 2.5)H_f.$$

For optimum performance, the clearance between the fan blade tips and the shroud should be a minimum, theoretically zero. In practice, however, it is nearly impossible to manufacture, ship, install and operate a fan and shroud assembly having a clearance near zero because of the difficulties in manufacturing a fan whose blades are all the same length and a shroud orifice that is perfectly round, balancing the fan and centering the fan within the shroud. Therefore, some clearance must be allowed between the fan blade tips and the shroud orifice. It has been found that the orificed shroud of the present invention produces optimum results when the blade tip clearance $C_f$ is about five to fifteen thousandths (0.005 to 0.015) of the swept diameter of the fan or $$C=(D_t-D_f)/2=(0.005 \text{ to } 0.015)D_f, \text{ thus}$$

the throat diameter of the shroud should be one and ten to one and thirty thousandths (1.010 to 1.030) times the swept diameter of the fan or $$D_t=(1.010 \text{ or } 1.030)D_f.$$

The diameter of the discharge end of the shroud, $D_o$, is determined by the dimensions and configuration of the outside enclosure, the discharge grille and other design considerations. $D_o$ should be as large as those other dimensions and considerations will allow.

Tests of a fan having a shroud constructed with physical characteristics conforming to parameters within the above ranges, i.e. $A_m=0.1D_f$, $A_M/A_m=2.5$, $H_O=A_M/2+1.8H_f$ and $D_t=1.02D_f$, yielded results indicating a reduction in sound power levels of 7 dBa compared to the noise levels from a typical prior art shroud.

The configuration of the interior and exterior walls downstream of the ellipsoidal (in cross section) inlet end is not critical to the performance of the shroud. Indeed, it is not even necessary that there be an interior wall downstream of the throat. However, such a configuration would suffer some of the same disadvantages, e.g. debris and water collection, as the prior art shroud depicted in FIG. 1A and discussed above. Plane closed curve C depicted in FIG. 3 is a configuration that, when rotated about axis of generation $A_g$, will result in a toroidal shape for a shroud that has the desired air flow characteristics and is pleasing aesthetically.

Curve segment $S_e$ will, when rotated, produce the exterior wall of the toroidal shroud. The configuration of the exterior wall is not particularly critical to the air flow performance of the shroud. In a preferred embodiment, $S_e$ is a straight line from the discharge end, defined by point E, tangent to the ellipsoid on the side of the ellipsoid away from the axis of generation. Curve segment $S_d$ will, when rotated, produce the interior wall of the toroidal shroud. The exact configuration of the interior is not critical to the air flow performance of the shroud. In a preferred embodiment, $S_d$ is the arc of a circle having radius R and center c lying on minor axis $A_m$ of the ellipsoid as extended away from axis of generation $A_g$ and connecting point E and point m, point m being the intersection of the ellipsoid with minor axis $A_m$ on the side of the ellipsoid that is toward axis of generation $A_g$. Another satisfactory configuration for the interior wall (not shown) is the surface produced by rotating a straight line from point E tangent to the ellipsoid on the side of the ellipsoid toward axis of generation $A_g$.

Describing the entire orifice wall in terms of a surface generated by rotating a line about an axis as has been done in the above discussion is primarily for simplicity and ease of explanation. The inlet portion, including the leading edge and the throat of the orifice wall must necessarily be circular in order to achieve a close fit around the fan with which the orifice is used, but the discharge portion and trailing edge of the wall need not be circular. Equally satisfactory is a configuration in which the trailing edge is not circular but some other shape, e.g. substantially square or rectangular, as might be more appropriate when it is desired to conform the orificed shroud to an outside enclosure that is not circular. In all cases, the area enclosed by the trailing edge should be as large as possible consistent with other design considerations. The discharge portion of the orifice wall should smoothly transition from the throat to the trailing edge with no cross sectional area, taken in a plane normal to the axis of rotation of the fan, in the discharge section of the orifice being less than the cross sectional area of the orifice throat. It is also not necessary that the plane containing the orifice leading edge be parallel to the plane containing the orifice trailing edge, as deviation from such parallelism will not adversely affect orifice performance.

The shroud of the present invention can be manufactured of any suitable material by any suitable process. One such material is a plastic such as polyethylene. A suitable fabrication process for a toroidal plastic shroud is blow molding. A blow molded toroidal shroud would be hollow and therefore be lighter in weight, require less material and be less costly than a solid shroud fabricated from the same material, but have the same air flow performance.

The above description is illustrative and not limiting. Only the following claims limit the scope of the claimed invention.

What is claimed is:

1. (Amended) An orificed shroud, for use with an axial flow fan having an axis of rotation, comprising a wall structure having a throat, an inlet portion having a leading edge, an exterior portion and a trailing edge downstream with respect to said axial flow from said throat, said wall structure being in form like the surface generated by rotating a curvilinear planar line about a coplanar axis of generation coincident with said axis of rotation, said curvilinear planar line having an ellipsoidal segment, said ellipsoidal segment having a minor axis and a major axis with said major axis being parallel to said axis of rotation, that would, when rotated about said axis of generation, generate said inlet portion, a first point, at the intersection of said ellipsoid with said minor axis on the side of said ellipsoid that is toward said axis of generation, defining an end that would, when rotated about said axis of generation, generate said throat, a second point defining an end that would, when rotated about said axis of generation, generate said trailing edge and an exterior segment connecting the side of said ellipsoid that is away from said axis of generation with said second point that would, when rotated about said axis of generation, generate said exterior portion.

2. The orificed shroud of claim 1 in which said exterior segment is a straight line from said second point tangent to said ellipsoid on the side of said ellipsoid that is away from said axis of generation.

3. The orificed shroud of claim 1 in which said curvilinear planar line further comprises an interior segment connecting said first point and said second point so that said curvilinear planar line is a plane closed curve and said wall structure further comprises an interior portion that is in form like the surface generated by rotating said interior segment about said axis of generation so that said wall structure is a generally toroidal member in form like the toroid generated by rotating said plane closed curve about said axis of generation.

4. The orificed shroud of claim 3 in which said interior segment is an arc of a circle having its center lying on the minor axis of said ellipsoid extended away from said axis of generation and connecting said first and second points.

5. The orificed shroud of claim 3 in which said interior segment is a straight line.

6. A fan and orificed shroud assembly comprising:

a fan of the axial flow type having a plurality of blades extending radially from an axis of rotation, each of said blades having a blade leading edge, a blade trailing edge and a tip, a swept diameter, said swept diameter being the diameter of the circle described when that point on one of said blades that is farthest from said axis of rotation rotates about said axis of rotation, and a blade axial depth, said blade axial depth being the normal distance between a first plane normal to the rotational axis of said fan passing through a point on said blade leading edge that is four tenths (0.4) of said swept diameter from said axis of rotation and a second plane normal to the rotational axis of said fan passing through a point on said blade trailing edge that is four tenths (0.4) of said swept diameter from said axis of rotation; and a wall structure having a throat, an ellipsoidal inlet portion having a leading edge, an exterior portion, a trailing edge downstream with respect to said axial flow from said throat and an axial distance from said wall structure leading edge to said wall structure trailing edge, said wall structure being in form like the surface generated by rotating a curvilinear planar line about a coplanar axis of generation coincident with said axis of rotation, said curvilinear planar line having an ellipsoidal segment, said ellipsoidal segment having a minor axis that is between eight and fifteen hundredths (0.08 and 0.15) of said swept diameter and a major axis that is parallel to said axis of rotation and between one and one half and three and one half (1.5 and 3.5) times said minor axis, that would, when rotated about said axis of generation, generate said inlet portion, a first point, at the intersection of said ellipsoid with said minor axis on the side of said ellipsoid that is toward said axis of generation, defining an end that would, when rotated about said axis of generation, generate said throat, a second point defining an end that would, when rotated about said axis of generation, generate said trailing edge and an exterior segment connecting the side of said ellipsoid that is away from said axis of generation with said second point that would, when rotated about said axis of generation, generate said exterior portion and said wall structure axial distance being equal to one half (0.5) said ellipsoid major axis plus one half to two and one half (0.5 to 2.5) times said blade axial depth.

7. The fan and orificed shroud assembly of claim 6 in which said exterior segment comprises a straight line from said second point tangent to said ellipsoid on the side of said ellipsoid that is away from said axis of generation.

8. The fan and orificed shroud assembly of claim 6 in which said curvilinear planar line further comprises an interior segment connecting said first point and said second point so that said curvilinear planar line is a plane closed curve and said wall structure further comprises an interior portion that is in form like the surface generated by rotating said interior segment about said axis of generation so that said wall structure is a generally toroidal member in form like the toroid generated by rotating said plane closed curve about said axis of generation.

9. The fan and orificed shroud assembly of claim 8 in which said interior segment is the arc of a circle having its center lying on the minor axis of said ellipsoid extended away from said axis of generation and connecting said first and second points.

10. The fan and orificed shroud assembly of claim 8 in which said interior segment is a straight line.

11. The fan and orificed shroud assembly of claim 6 in which the clearance between said throat and said blade tips is between five and fifteen thousandths (0.005 and 0.015) of said swept diameter.

12. The fan and orificed shroud assembly of claim 6 in which said minor axis is one tenth (0.1) of said swept diameter, said major axis is two and one half (2.5) times said minor axis and said wall structure axial distance is equal to one and eight tenths (1.8) times said blade axial depth.

13. The fan and orificed shroud assembly of claim 12 in which the clearance between said throat and said blade tips is one hundredth (0.01) of said swept diameter.

14. An orificed shroud, for use with an axial flow fan having an axis of rotation, comprising a wall structure having a throat, an inlet portion, a trailing edge downstream with respect to said axial flow from said throat and an exterior portion;

said throat and inlet portion of said wall structure being in form like the surface generated by rotating a curvilinear planar line about a coplanar axis of generation coincident with said axis of rotation, said curvilinear planar line having an ellipsoidal segment, said ellipsoidal segment having a minor axis and a major axis, said major axis being parallel to said axis of rotation, that would, when rotated about said axis of generation, generate said inlet portion, a first point, at the intersection of said ellipsoid with said minor axis on the side of said ellipsoid that is toward said axis of generation, defining an end that would, when rotated about said axis of generation, generate said throat, and a range of second points, lying on the side of said ellipsoid that is away from said axis of generation defining a segment that would, when rotated about said axis of generation, generate the area of transition from said inlet portion to said exterior portion;

said trailing edge being a plane closed curve of a configuration so that the length of every straight line that connects two points on said plane closed curve and also passes through said axis of generation is equal to or greater than the diameter of said throat; and said exterior portion being a single, continuous surface joining said transition to said trailing edge.

15. The orificed shroud of claim 14 in which any section of said exterior portion made by any plane in which said axis of generation also lies is a straight line and is also tangent to said ellipsoid on the side of said ellipsoid that is away from said axis of generation.

16. The orificed shroud of claim 14 in which said wall structure further comprises an interior portion, said interior portion being a single, continuous surface joining said throat portion to said plane closed curve.

17. The orificed shroud of claim 16 in which any section of said interior portion made by any plane in which said axis of generation also lies is an arc of a circle.

18. The orificed shroud of claim 14 in which any section of said interior portion made by any plane in which said axis of generation also lies is a straight line.

19. A fan and orificed shroud assembly comprising:

a fan of the axial flow type having a plurality of blades extending radially from an axis of rotation, each of said blades having a blade leading edge, a blade trailing edge and a tip, a swept diameter, said swept diameter being the diameter of the circle described when that point on one of said blades that is farthest from said axis of rotation rotates about said axis of rotation, and a blade axial depth, said blade axial length being the normal distance between a first plane normal to the rotational axis of said fan passing through a point on said blade leading edge that is four tenths (0.4) of said swept diameter from said axis of rotation and a second plane normal to the rotational axis of said fan passing through a point on said blade trailing edge that is four tenths (0.4) of said swept diameter from said axis of rotation; and a wall structure having a throat, an inlet portion having a leading edge, a trailing edge downstream with respect to said axial flow from said throat, an exterior portion and an axial distance from said wall structure leading edge to said wall structure trailing edge, said throat and inlet portion being in form like the surface generated by rotating a curvilinear planar line about a coplanar axis of generation coincident with said axis of rotation, said curvilinear planar line having an ellipsoidal segment, said ellipsoidal segment having a minor axis that is between eight and fifteen hundredths (0.08 and 0.15) of said swept diameter and a major axis that is parallel to said axis of rotation and between one and one half and three and one half (1.5 and 3.5) times said minor axis, that would, when rotated about said axis of generation, generate said inlet portion, a first point, at the intersection of said ellipsoid with said minor axis on the side of said ellipsoid that is toward said axis of generation, defining an end that would, when rotated about said axis of generation, generate said throat, and a range of second points, lying on the side of said ellipsoid that is away from said axis of generation defining a segment that would, when rotated about said axis of generation, generate the transition from said inlet portion to said exterior portion;

said trailing edge being a plane closed curve of a configuration so that the length of every straight line that connects two points on said plane closed curve and also passed through said axis of generation is equal to or greater than the diameter of said throat;

said exterior portion being a single, continuous surface joining said transition to said plane closed curve; and said wall structure axial distance being equal to one half (0.5) said ellipsoid major axis plus one half to two and one half (0.5 to 2.5) times said blade axial depth.

20. The fan and orificed shroud assembly of claim 19 in which any section of said exterior portion made by any plane in which said axis of generation also lies is a straight line and is also tangent to said ellipsoid on the side of said ellipsoid that is away from said axis of generation.

21. The fan and orificed shroud assembly of claim 19 in which said wall structure further comprises an interior portion, said interior portion being a single, continuous surface joining said throat portion to said trailing edge.

22. The fan and orificed shroud assembly of claim 21 in which any section of said interior portion made by any plane in which said axis of generation also lies is an arc of a circle.

23. The fan and orificed shroud assembly of claim 21 in which any section of said interior portion made by any plane in which said axis of generation also lies is a straight line.

24. The fan and orificed shroud assembly of claim 19 in which the clearance between said throat and said blade tips is between five and fifteen thousandths (0.005 and 0.015) of said swept diameter.

25. The fan and orificed shroud assembly of claim 19 in which said minor axis is one tenth (0.1) of said swept diameter, said major axis is two and one half (2.5) times said minor axis and said wall structure axial distance in equal to one and eight tenths (1.8) times said blade axial length.

26. The fan and orificed shroud assembly of claim 25 in which the clearance between said throat and said blade tips is one hundredth (0.01) of said swept diameter.

* * * * *